US005901599A

United States Patent [19]

Sato et al.

[11] Patent Number: 5,901,599

[45] Date of Patent: May 11, 1999

[54] METHOD AND APPARATUS FOR SHEET FORMING A BLANK USING A VARIABLE BEAD

[75] Inventors: Akihito Sato, Toyota; Shinichiro Nakamura, Nagoya; Takashi Hosoe, Toyota; Atsunobu Murata, Gifu-ken, all of Japan

[73] Assignees: Toyota Jidosha Kabushiki Kaisha, Toyota; Kabushiki Kaisha Toyota Chuokenkyusho, Aichi-gun, both of Japan

[21] Appl. No.: 08/682,411

[22] Filed: Jul. 17, 1996

[30] Foreign Application Priority Data

Jul. 18, 1995 [JP] Japan ..... 7-181988

[51] Int. Cl.[6] ..... B21D 22/00; B21C 37/02

[52] U.S. Cl. ..... 72/350; 72/379.2

[58] Field of Search ..... 72/350, 351, 379.2, 72/352, 354.6, 356, 358, 359

[56] References Cited

U.S. PATENT DOCUMENTS

| | | | |
|---|---|---|---|
| 2,312,749 | 3/1943 | Bullock | 72/348 |
| 3,263,637 | 8/1966 | Cox | 72/348 |
| 4,195,510 | 4/1980 | Juergens | 72/350 |
| 4,432,222 | 2/1984 | Ujihara et al. | 72/350 |
| 5,157,969 | 10/1992 | Roper | 72/350 |
| 5,372,027 | 12/1994 | Roper et al. | 72/350 |

FOREIGN PATENT DOCUMENTS

| | | | |
|---|---|---|---|
| 57-72730 | 5/1982 | Japan . | |
| 59-159227 | 9/1984 | Japan | 72/350 |
| 59-206120 | 11/1984 | Japan . | |
| 64-27726 | 1/1989 | Japan . | |
| 3-71932 | 3/1991 | Japan . | |
| 4-17315 | 2/1992 | Japan . | |

*Primary Examiner*—Joseph J. Hail, III
*Assistant Examiner*—Rodney Butler
*Attorney, Agent, or Firm*—Pillsbury Madison & Sutro LLP

[57] ABSTRACT

A sheet forming method including the steps of: holding a blank between a blank holder and an opposing die so that wrinkling is prevented in the blank; and forming the blank to an objective shape with a punch, while imposing a force of a variable bead on the blank at a selected position in a point manner and only during a part of the entire forming period selectively. An apparatus for conducting the above method.

23 Claims, 7 Drawing Sheets

METHOD AND APPARATUS FOR SHEET FORMING A BLANK USING A VARIABLE BEAD

BACKGROUND OF THE INVENTION

1. Field of the Invention

The present invention relates to a sheet forming (including drawing) method and apparatus wherein a bead capable of applying a variable bead force to a blank (hereinafter, a variable bead) is operated to be effective selectively in position and time and to press a blank in a point manner so that formability of the blank is improved (and, breakage of the blank during sheet forming is essentially prevented).

2. Description of Related Art

In conventional methods of drawing, in order to prevent breakage of a blank during drawing, methods such as selecting a blank material having a high extensibility, increasing a thickness of a blank, and coating lubricating oil of a high lubrication on a blank have been used.

Further, Japanese Patent Publication SHO 59-206120, the disclose of which is hereby incorporated by reference, discloses a longitudinal bead capable of applying a variable bead force to a blank. The force of the longitudinal bead is made less effective at a predetermined stage of the forming time period to improve the formability of the blank.

However, the conventional drawing methods described above have the following problems:

Grading-up the blank material and increasing the blank thickness is accompanied by an increase in manufacturing cost. High lubrication of the oil is accompanied by sliding of the blank relative to the dies, which will generate wrinkling in the blank during drawing and will lower the dimensional accuracy of the blank.

With the longitudinal variable bead, because the bead should be movable relative to either one of a blank holder and an opposing die to which the bead is mounted, it is difficult to embody a movable longitudinal bead structure in a bead mounting die.

SUMMARY OF THE INVENTION

An object of the present invention is to provide a sheet forming (including drawing) method and apparatus which can improve formability of a blank (i.e., prevent breakage in the blank during sheet forming) without wrinkling the blank during sheet forming and decreasing the dimensional accuracy of the blank during sheet forming.

A sheet forming (including drawing) method using one or more variable beads according to the present invention includes the following steps of: holding a blank between a blank holder (or both a blank holder and a fixed die) and an opposing die so that wrinkling is essentially prevented in the blank; and forming the blank to an objective shape with a punch. The sheet forming method imposes a force of the variable bead(s) on selected portions of said blank in a point manner and during only a part of an entire forming time period selectively.

A sheet forming (including drawing) apparatus using one or more variable beads according to the present invention includes: a blank holder (or both a blank holder and a fixed die) and an opposing die for holding a blank therebetween so that wrinkling is essentially prevented in the blank; a punch for forming the blank to an objective shape; and one or more variable beads for imposing forces on selected portions of said blank in a point manner and during only a part of an entire forming time period selectively.

In the above-described method and apparatus, the blank holder (or both a blank holder and a fixed die) and the opposing die prevent wrinkling in the blank during sheet forming and ensure dimensional accuracy of the formed blank.

In addition, breakage of the blank is essentially prevented by operating the variable beads in a point manner and during only a part of an entire forming time period. In the method and apparatus of the present invention, breakage of the blank is effectively prevented by selecting the contact position of the bead on the blank and the bead force operating time period. Position and operating time of the bead force may be adjusted according to an objective shape to which the blank is formed. In the conventional methods and apparatuses it has been conceived that bead force is counter to prevention of breakage of a blank.

BRIEF DESCRIPTION OF THE DRAWINGS

The above and other objects, features, and advantages of the present invention will become more apparent and will be more readily appreciated from the following detailed description of the preferred embodiments of the present invention in conjunction with the accompanying drawings, in which.

DETAILED DESCRIPTION OF THE PREFERRED EMBODIMENT

Figure 6:
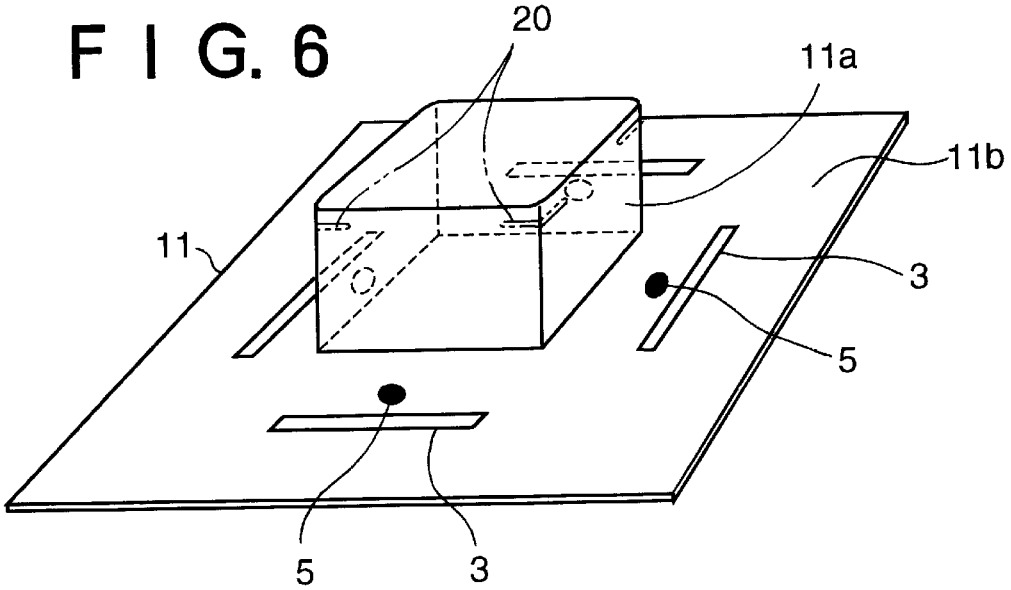
FIG. 6 is an oblique view of an objective shape to which a blank is formed with the applied bead force points shown, in a sheet forming (including drawing) method and apparatus according to a second embodiment of the present invention.
Figure 7:
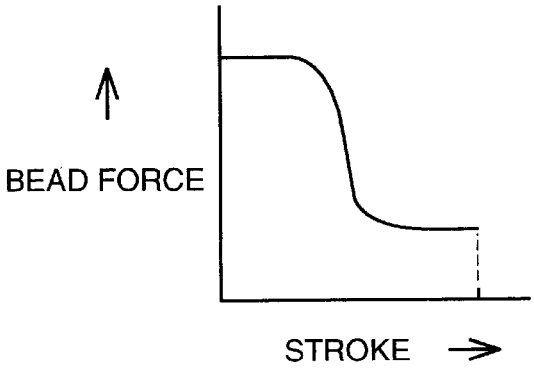
FIG. 7 is a graph showing the relationship between the bead force and drawing stroke applied in the drawing of the objective shape of FIG. 6.
Figure 8:
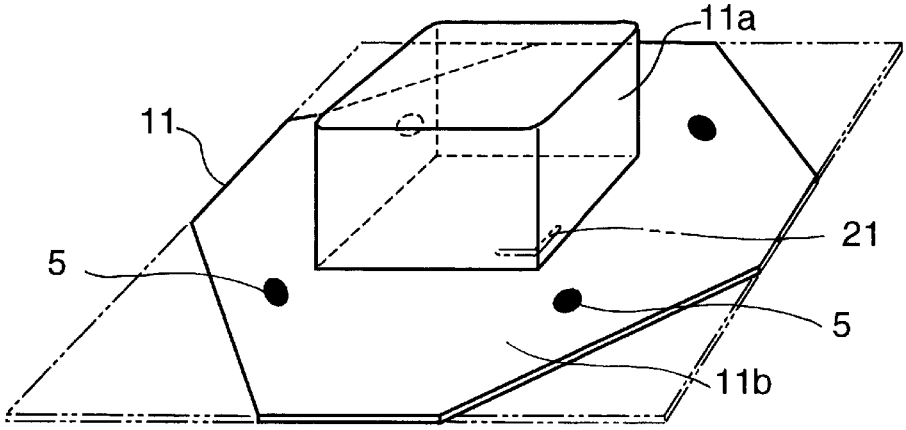
FIG. 8 is an oblique view of an objective shape to which a blank is formed with the applied bead force points shown, in a sheet forming (including drawing) method and apparatus according to a third embodiment of the present invention.
Figure 9:
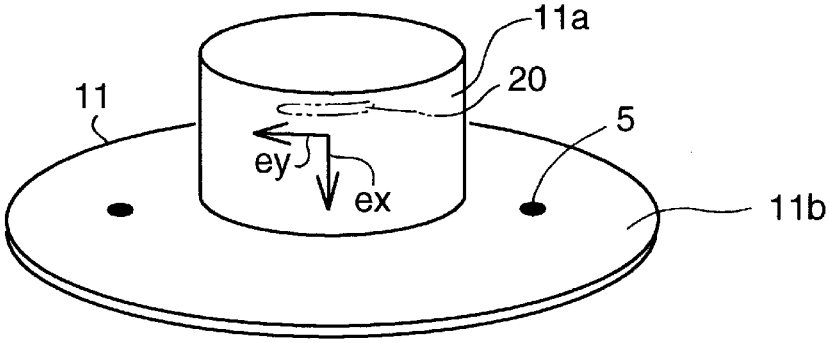
FIG. 9 is an oblique view of an objective shape to which a blank is formed with the applied bead force points shown, in a sheet forming (including drawing) method and apparatus according to a fourth embodiment of the present invention.
Figure 10:
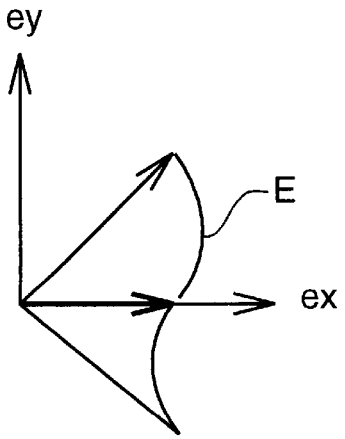
FIG. 10 is a diagram showing the relationship between strains $e_x$, $e_y$ and a strain limit curve in the drawing of the objective shape of FIG. 9.
Figure 11:
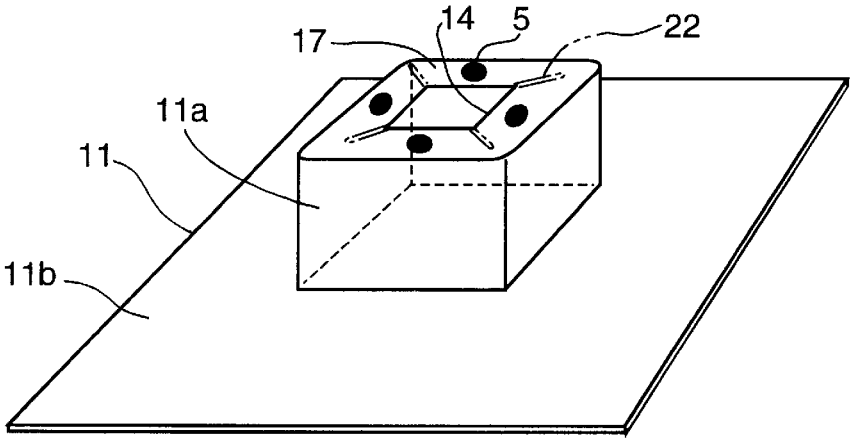
FIG. 11 is an oblique view of an objective shape to which a blank is formed with the applied bead force points shown, in a sheet forming (including drawing) method and apparatus according to a fifth embodiment of the present invention.
Figure 12:
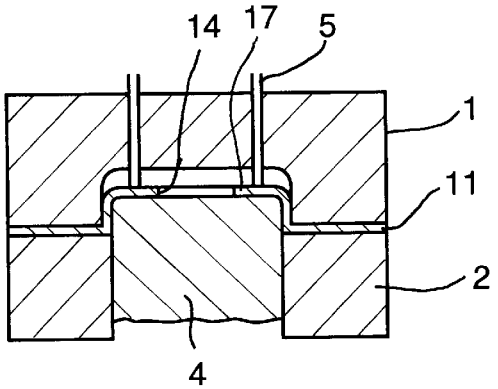
FIG. 12 is a cross-sectional view of an apparatus for conducting the drawing of the objective shape of FIG. 11.
Figure 13:
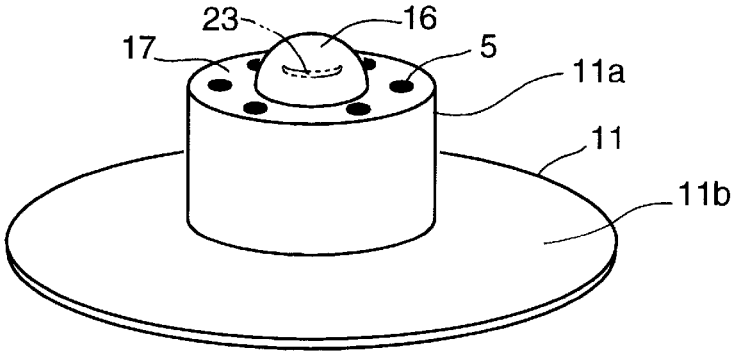
FIG. 13 is an oblique view of an objective shape to which a blank is formed with the applied bead force points shown, in a sheet forming (including drawing) method and apparatus according to a sixth embodiment of the present invention.
Figure 14:
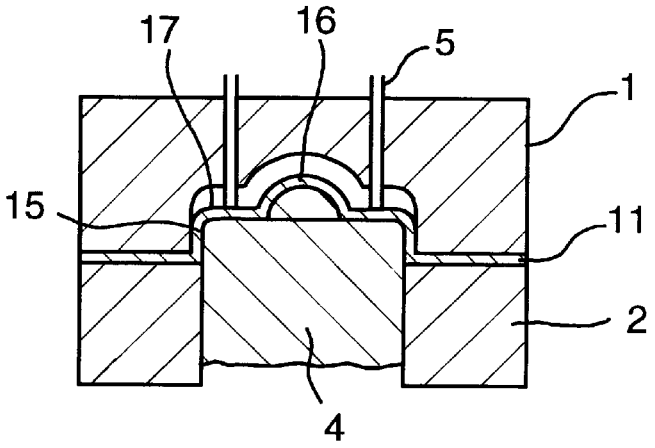
FIG. 14 is a cross-sectional view of an apparatus for conducting the sheet forming (including drawing) of the objective shape of FIG. 13.
Figure 15:
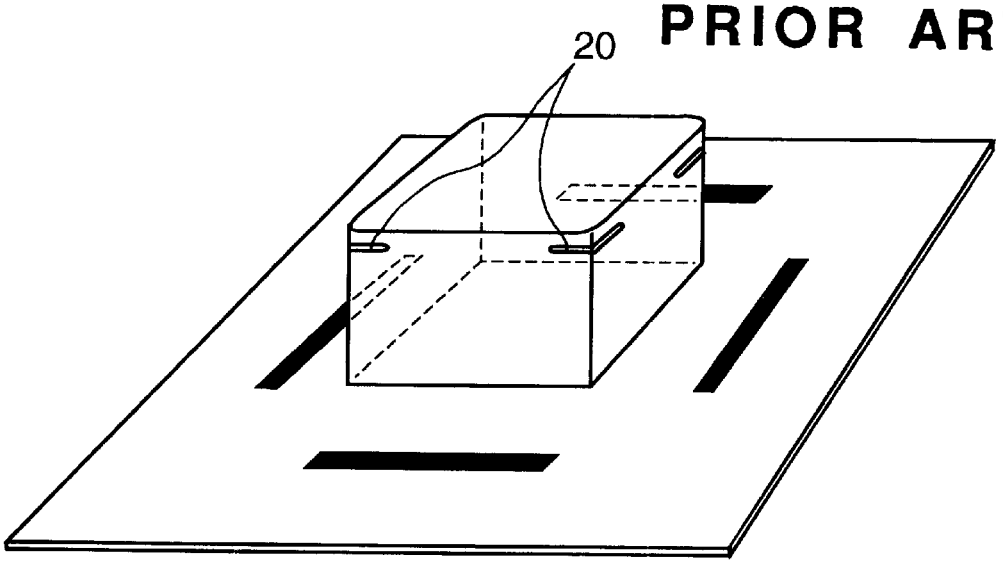
FIG. 15 PRIOR ART
FIG. 15 is an oblique view of an objective shape to which a blank is formed with the applied bead force lines shown, in a conventional drawing method and apparatus.

FIGS. 1–5 illustrate a method and apparatus according to a first embodiment of the present invention; FIGS. 6 and 7 illustrate a method and apparatus according to a second embodiment of the present invention; FIG. 8 illustrates a method and apparatus according to a third embodiment of the present invention; FIGS. 9 and 10 illustrate a method and apparatus according to a fourth embodiment of the present invention; FIGS. 11 and 12 illustrate a method and apparatus according to a fifth embodiment of the present invention; and FIGS. 13 and 14 illustrate a method and apparatus according to a sixth embodiment of the present invention. FIG. 15 illustrates an objective shape to which a blank is formed in a conventional apparatus.

Portions common to all of the embodiments of the present invention are denoted with the same reference numerals throughout the description and the drawings of the several embodiments of the present invention.

The present invention is applicable to any one of a single-action sheet forming (including drawing) and a double-action sheet forming (including drawing) method and apparatus.

Figure 1:
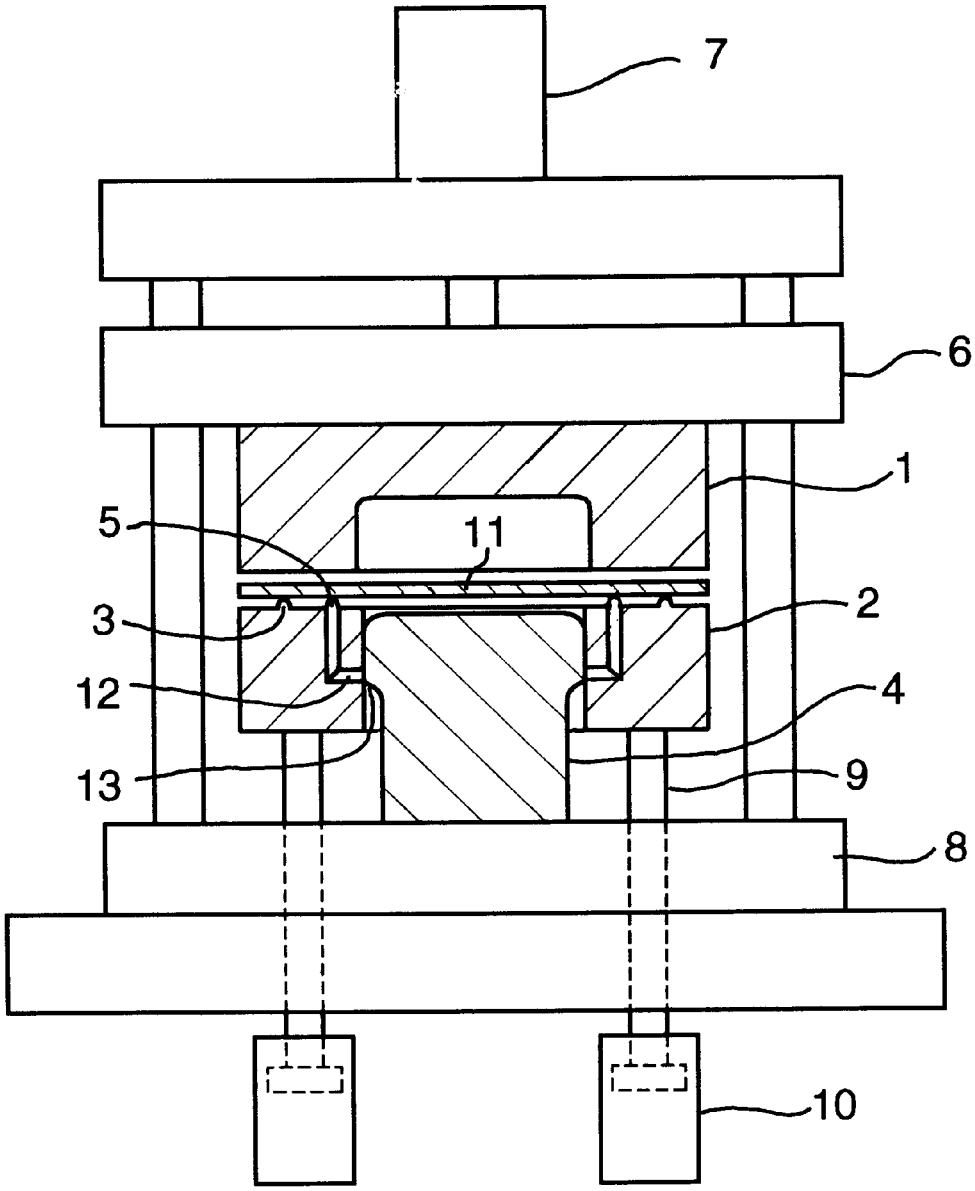
FIG. 1 is a front elevational view, partially sectioned, of an apparatus for conducting a single-action sheet forming (including drawing) method according to a first embodiment of the present invention.

As illustrated in FIG. 1, a single-action sheet forming (including drawing) is a sheet forming (including drawing) conducted using a single-action press machine including a cushion. In the single-action sheet forming (including drawing) of FIG. 1, a blank 11 is held between a blank holder (which may be called a cushion ring) 2 and an opposing die 1. Then, the die 1 and the blank holder 2 are lowered toward a stationary punch 4 so that the blank 11 is drawn (formed) by the punch 4. In the single-action sheet forming (including drawing) of FIG. 1, an upper die includes the die 1, and a lower die includes the blank holder 2 and the punch 4. Preferably, one or more variable beads 5 are disposed in at least one of the die 1 (not shown) and the blank holder 2. The variable beads 5 may be disposed in (a) either the die 1 or the blank holder 2, or (b) both the die 1 and the blank holder 2. The variable bead 5 is capable of movement independent of the die 1 and the blank holder 2. FIG. 1 shows that each variable bead 5 is disposed in the blank holder 2 and is capable of movement independent of the blank holder 2, and toward and away from the die 1. If the variable bead 5 were disposed in the die 1 (not shown), it would be capable of movement independent of the die 1, and toward and away from the blank holder 2.

Figure 2:
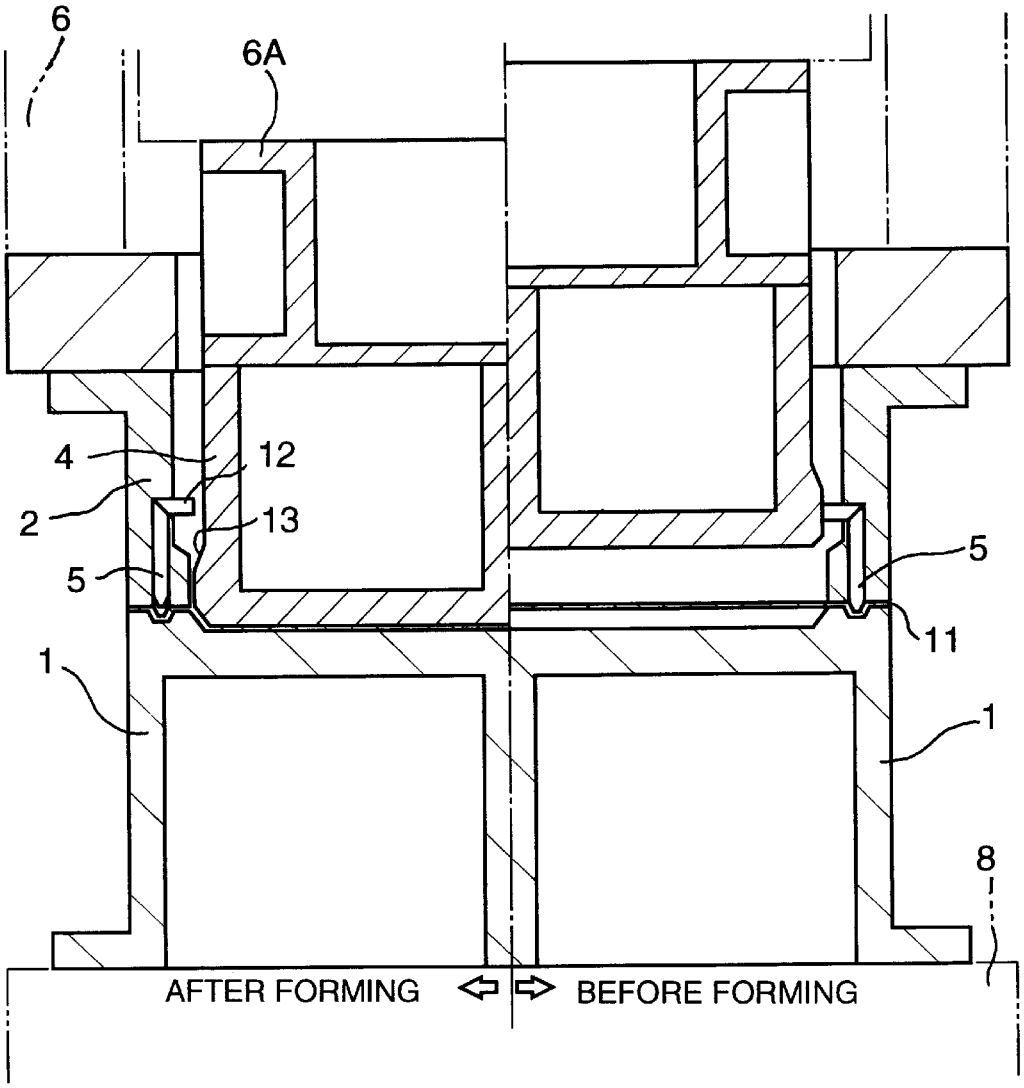
FIG. 2 is a front elevational view, partially sectioned, of an apparatus for conducting a double-action sheet forming (including drawing) method according to a first embodiment of the present invention.

As illustrated in FIG. 2, a double-action sheet forming (including drawing) having two steps is conducted using a double-action press machine. In the double-action sheet forming (including drawing) of FIG. 2, a blank holder 2 coupled to an outer ram 6 of a press machine is first lowered to hold a blank 11 between the blank holder 2 and an opposing die 1. Then, a punch 4 coupled to an inner ram 6A is lowered to draw (form) the blank 11. In the double-action sheet forming (including drawing) of FIG. 2, an upper die includes the blank holder 2 and the punch 4 and a lower die includes the opposing die 1. Preferably, one or more variable beads 5 are disposed in at least one of the die 1 (not shown) and the blank holder 2. The variable beads 5 may be disposed in (a) either the die 1 or the blank holder 2, or (b) both the die 1 and the blank holder 2. The variable bead 5 is capable of movement independent of the die 1 and the blank holder 2. FIG. 2 shows that each variable bead 5 is disposed in the blank holder 2 and is capable of movement independent of the blank holder 2, and toward and away from the die 1. If the variable bead 5 were disposed in the die 1 (not shown), it would be capable of movement independent of the die 1, and toward and away from the blank holder 2.

First, portions common to all of the embodiments of the present invention will be explained with reference to, for example, FIGS. 1–5. A sheet forming (including drawing) apparatus using one or more variable beads according to the present invention includes a die 1, a blank holder 2, one or more fixed beads 3 (optional), a punch 4, and a variable point bead 5. The die 1 is an opposing die of the blank holder 2.

In the single-action press machine of FIG. 1, the die 1 is coupled to the upper ram 6 of the press machine, so that when the upper ram 6 is moved by an oil pressure cylinder 7, the die 1 moves together with the upper ram 6. The punch 4, which is a stationary member, is directly or indirectly coupled to a bolster 8 of the press machine. The blank holder (or cushion ring) 2 extends continuously around the punch 4 to surround the punch 4 and is supported via pins 9 by oil pressure cylinders 10. When the die 1 is lowered, the die 1 and the cushion ring 2 hold the blank 11 therebetween. When the die 1 is further lowered, the die 1 pushes and lowers the cushion ring 2 overcoming an upward biasing force of the cylinders 10. When the die 1 is returned upwardly to an original position, the cushion ring 2 also moves upwardly to an original position of the cushion ring 2 biased by the cylinders 10. The fixed beads 3 are formed in the die 1 (not shown) or the cushion ring 2. In FIG. 1, the fixed beads 3, is formed in the cushion ring 2, and the die 1 holds the blank 11 therebetween. The blank 11 is supplied onto the cushion ring 2 when the cushion ring 2 is positioned at its uppermost (original) position. During the downward stroke of the die 1 and the cushion ring 2, the blank 11 is formed by the stationary punch 4.

In the double-action press machine of FIG. 2, the upper blank holder 2 is coupled to the upper ram 6 of the press machine, so that when the upper ram 6 is moved, the upper blank holder 2 moves together with the upper ram 6. The punch 4 is coupled to the inner ram 6A so that the punch 4 moves together with the inner ram 6A. The die 1, which is a stationary member, is directly or indirectly coupled to a bolster 8 of the press machine. The upper blank holder 2 extends continuously around the punch 4 to surround the punch 4. The upper blank holder 2 and the die 1 hold the blank 11 therebetween. Optional fixed beads 3 (not shown) are formed in either the die 1 or the upper blank holder 2. The fixed beads 3 (if formed in the upper blank holder 2) and the die 1 hold an outer portion of the blank 11 therebetween. The fixed beads 3 (if formed in the die 1) and the upper blank holder 2 hold an outer portion of the blank 11 therebetween.

The blank 11 is supplied onto the die 1. When the upper blank holder 2 is lowered, the blank 11 is held between the upper blank holder 2 and the die 1, and then when the punch 4 is lowered, the blank 11 is formed by the punch 4.

With reference to FIGS. 1–2, the variable point beads 5 are disposed in either the blank holder 2 or the die 1 (not shown) so that the variable beads 5 are capable of movement relative to the blank holder 2 or the die 1, and toward and away from the blank 11. Due to the movable structure of the variable beads relative to the blank 11, the blank pressing force of the beads (bead force) can vary during the forming time period. The variable beads 5 contact and apply a pressing force against the blank 11 in a point manner. In this connection, "point" means "not a line" and may include a substantially circular (non-pinpoint) area.

The movement of the variable bead 5 is accomplished by a variable bead driving mechanism. The mechanism includes, for example, a pushing rod 12 laterally extending at a lower end of the variable bead 5 and contacting the variable bead 5 via an oblique surface, and a cam surface 13 formed on a side surface of the punch 4 that is capable of engaging and disengaging an end of the pushing rod 12. In the embodiments of FIGS. 1 and 2, at an early stage of the drawing, the cam surface 13 engages the pushing rod 12 and variable bead 5 protrudes from a blank holding surface of the blank holder 2 so that the bead force is effective. At a later stage of the drawing, the cam surface 13 disengages the pushing rod 12 and the variable bead 5 recedes to a position of the blank holding surface of the blank holder 2 so that the bead force is ineffective. In this connection, by selecting the contour of the cam surface 13, the relative movement and bead force (defined as a pushing force of the bead acting on the blank) of the variable bead 5 can be controlled.

A sheet forming (including drawing) method using one or more variable beads according to the present invention includes the steps of: (1) holding the blank 11 between (a) the blank holder 2 and (b) the opposing die 1, with the blank holder 2 or the die 1 optionally including one or more fixed beads 3, so that wrinkling is prevented in the blank 11; and (2) forming the blank 11 to an objective shape by the punch 4. A force of each variable bead 5 is imposed on the blank 11 at a selected position of the blank 11 in a point manner and during only at a partial time period of the entire forming selectively.

When one or both of the variable bead 5 and the punch 4 moves relative to the other, the variable bead 5 is moved relative to the blank 11 via the cam surface 13 of the punch 4 and the pushing rod 12 so that the bead force of the variable bead 5 is effective only for a partial time period of the forming. Because the variable bead 5 is a rod-shaped or the like, the variable bead 5 generates a point-like bead force. Therefore, it is easier in the variable point bead 5 than in the conventional line-like bead to determine a shape of a bead force operating area to a desirable shape. As a result, it is easy to impose the point-like bead forces selectively on portions of the blank where breakage does not tend to occur (for example, in the case of a member having a square shell at a central portion of the member and a flat flange around the square shell, a portion of the flange adjacent a midpoint of a straight side of a cross section of the square shell) to resultantly increase the load which that portion can bear, whereby a load is decreased at portions of the blank where breakage does tend to occur (for example, in a case of the above member having a square shell at a central portion, a corner of the square shell) so that breakage at that portion is prevented. Even if the die 1 and the blank holder 2 has a complex structure (for example, a curved structure), the variable point bead 5, unlike the conventional line-like bead, can easily be mounted to the die 1 and/or the blank holder 2, for example, by curving a row of a plurality of parallelly disposed variable point beads to the contour of the complex structure.

Figure 3:
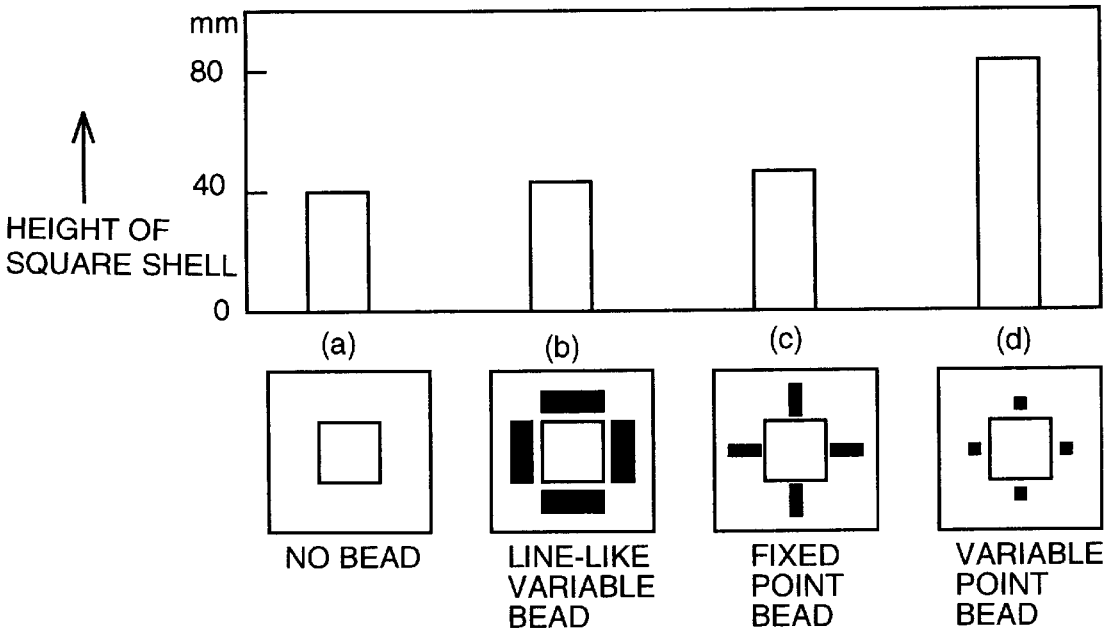
FIG. 3 is a graph showing test results regarding the relationship between various beads and the formability until breakage obtained thereby.

Test results of FIG. 3 show that a height of the square shell which can be formed in the blank by drawing using the variable point beads 5 without generating a breakage is greatly increased compared with a height of the square shell formed in a blank by drawing using the conventional beads. Though FIG. 3 shows the test results of the case where a square shell is formed in a blank, similar tests results (showing improved formability due to the variable point bead) were obtained even in the case of a shell having other cross-sectional shapes than a square formed in a blank.

In FIG. 3, case (a) shows a test result of a conventional drawing conducted using no bead, case (b) shows a test result of a conventional drawing conducted using a line-like variable bead, case (c) shows a test result of a drawing conducted using a fixed point bead (though such fixed point bead has not been used even in a conventional drawing), and case (d) shows a test result of the present invention where sheet forming (including drawing) was conducted using variable point beads 5. More particularly, in the case of (d), the bead force was imposed on portions of the flange adjacent the midpoint of the straight sides of a square cross section of the square shell formed in the blank only at an early stage of the drawing.

In FIG. 3, the area colored in black shows the area where a bead force was effective (a bead force was imposed). Case (d) of FIG. 3 shows that when line A (FIG. 4) comes to line B (FIG. 4) by drawing, the bead force of the variable point bead 5 is effective during only an early stage of the drawing time period, while case (c) of FIG. 3 shows that the bead force of the fixed bead is effective at all stages of the drawing. From FIG. 3, it is seen that formability until breakage is gradually improved from case (a) to case (c), and that the formability until breakage is as much as twice improved between case (c) and case (d).

Figure 4:
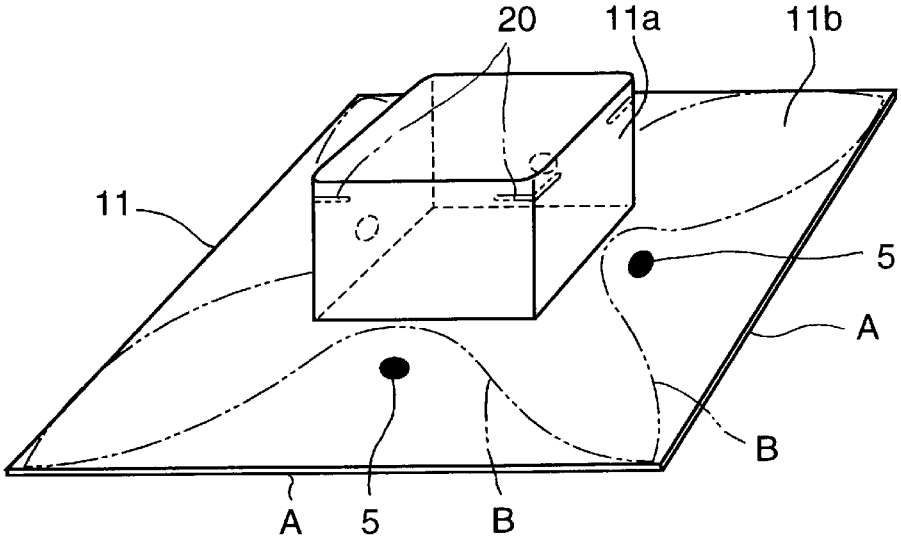
FIG. 4 is an oblique view of an objective shape to which a blank is formed with the applied bead force points shown, in a sheet forming (including drawing) method and apparatus according to a first embodiment of the present invention.

For example, a breakage 20 (FIG. 15) began to occur at a portion of each corner of the square shell corresponding to a shoulder of a punch in the case of (b) when the height of the square shell reached about 40 mm, while in the case of (d) the blank could be formed without breakage until the height of the square shell reached about 80 mm. In FIG. 4, a two-dotted line shows the breakage 20 which was caused at the portion of the corner of the square shell corresponding to a punch shoulder in the conventional drawings, but is not caused in the sheet forming (including drawing) according to the present invention. Similarly, in FIGS. 6, 8, 11, and 13, a two-dotted line shows the breakage (20, 21, 22, and 23, respectively), which was caused in the conventional drawings, but is prevented from occurring in the sheet forming (including drawing) according to the present invention.

Portions unique to each embodiment of the present invention will now be explained.

Figure 5:
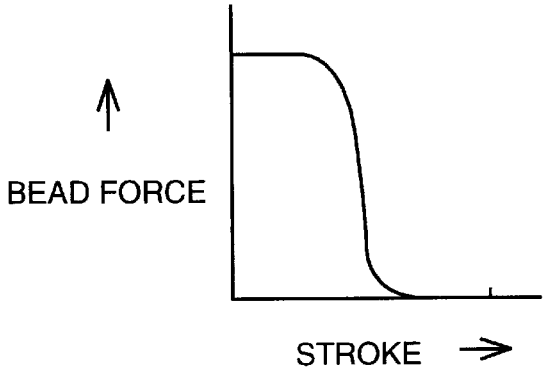
FIG. 5 is a graph showing the relationship between the bead force and drawing stroke applied in the drawing of the objective shape of FIG. 4.

In the first embodiment of the present invention, as illustrated in FIGS. 1–5, especially in FIGS. 4 and 5, the blank 11 is formed from a substantially square flat plate to a member having a square shell 11*a* with an end face at a central portion of the member and a flat flange 11*b* at a portion of the member surrounding the square shell 11*a*.

In the sheet forming (including drawing) apparatus, the position of each variable point bead 5 is selected so that bead forces are imposed on a portion of the flange adjacent to a midpoint of each straight side of a square cross section of the square shell 11*a*. An operative coupling between each variable point bead 5 and the cam surface 13 via each pushing rod 12 is selected so that the force of each variable point bead 5 is imposed on the blank 11 only at an early stage of the forming time period.

In the sheet forming (including drawing) method, the force of each variable point bead 5 is imposed on a portion of the flange 11*b* adjacent the midpoint of each straight side of the square cross section of the square shell 11*a* only at an early stage of the drawing. No bead force is imposed at a later stage of the drawing (FIG. 5).

The bead force of each variable point bead 5 imposed at the early stage of the drawing bears a part of the drawing load to decrease a load which the corners of the square shell bears, so that a breakage 20 at a portion of the square shell corresponding to a punch shoulder is effectively prevented. As a result, a decrease in thickness of the portion of the square shell corresponding to the punch shoulder is minimized, and a straight portion of the square shell can follow the shape of the punch shoulder. As a further result, the load which the straight portion of the square shell can bear is large, so that a breakage at the corner of the square shell is further suppressed.

In a second embodiment of the present invention, as illustrated in FIGS. 6 and 7, the blank 11 is formed from a substantially square flat plate to a member having a square shell 11*a* with an end face at a central portion of the member and a flat flange 11*b* at a portion of the member surrounding the square shell 11*a*.

In the sheet forming (including drawing) apparatus, the position of each fixed bead 3 is selected so that the bead force of each fixed bead 3 is imposed on a portion of the flange 11*b* along each straight side of a square cross section of the square shell 11*a*, and the position of each variable point bead 5 is selected so that the bead force of each variable point bead is imposed on a portion of the flange 11*b* adjacent a midpoint of each straight side of the square cross section of the square shell 11*a*. An operative coupling between each variable point bead 5 and the cam surface 13 via each pushing rod 12 is selected so that the force of each variable point bead 5 is imposed on the blank 11 only at an early stage of the forming time period.

In the sheet forming (including drawing) method, the force of each variable point bead 5 is imposed on a portion of the flange 11*b* adjacent the midpoint of each straight side of the square cross section of the square shell 11*a* only at an early stage of the drawing. Only a bead force of each fixed bead 3 is imposed at a later stage of the drawing (FIG. 7). The bead force of each fixed bead 3 is effective at all stages of the drawing.

The bead force of each variable point bead 5 imposed at the early stage of the drawing bears a part of the drawing load to decrease a load which the corners of the square shell bears, so that a breakage 20 at a portion of the square shell corresponding to a punch shoulder is effectively prevented.

In a third embodiment of the present invention, as illustrated in FIG. 8, the blank 11 is formed from a substantially square flat plate with four corners cut off to a member having a square shell 11*a* with an end face at a central portion of the member and a flat flange 11*b* at a portion of the member surrounding the square shell 11*a* with the cut four corners of the blank corresponding to the four corners of a square cross section of the square shell 11*a*. Due to the corners being cut off, the resistance of material flow of the portions of the blank corresponding to the cut portions decreases so that a wall breakage 21 tends to occur at the lower corners of the square shell 11*a*.

In order to prevent the wall breakage 21, in the apparatus, the position of each variable point bead 5 is selected so that the bead force of each variable point bead is imposed on a portion of the flange 11*b* adjacent each of the four corners of the square cross section of the square shell 11*a*. An operative coupling between each variable point bead 5 and the cam surface 13 via each pushing rod 12 is selected so that the force of each variable point bead 5 is imposed on the blank 11 more greatly at an early stage of the forming than at a later stage of the forming.

Thus, in the sheet forming (including drawing) method, the force of each variable point bead 5 is imposed on a portion of the flange 11*b* adjacent each of the four corners of the square cross section of the square shell 11*a* more greatly at an early stage of the forming than at a later stage of the forming.

Due to the above-described sheet forming (including drawing), both a wall breakage 21 at the lower corners of the square shell 11*a* and a breakage 20 (e.g., FIG. 6) at a portion of the square shell corresponding to a punch shoulder are prevented.

In a fourth embodiment of the present invention, as illustrated in FIGS. 9 and 10, the blank 11 is formed from a substantially circular flat face to a member having a cylindrical shell 11*a* with an end plate at a central portion of the member and a substantially circular flat flange 11*b* at a portion of the member surrounding the cylindrical shell 11*a*.

In the sheet forming (including drawing) apparatus, the position of each variable point bead 5 is selected so that the bead force of each variable point bead 5 is imposed on a portion of the flange 11*b* positioned on a diametrical line of a circular cross section of the cylindrical shell 11*a*. An operative coupling between each variable point bead 5 and the cam surface 13 via each pushing rod 12 is selected so that the force of each variable point bead 5 is imposed only at an early stage of the forming.

Thus, in the sheet forming (including drawing) method, the bead force of each variable point bead 5 is imposed only at an early stage of the forming.

A breakage 20 at a portion of the blank 11 is caused due to a plane strain. Because the bead force is imposed along a diametrical line, the uniaxial strain ($e_x$) in the case of no variable bead is changed to a biaxial strain ($e_x$, $e_y$) so that a distance from the zero point to the strain limit line E is increased (FIG. 10). As a result, the likelihood of a breakage 20 in the blank is reduced, and the formability of the blank having the cylindrical shell is improved.

In a fifth embodiment of the present invention, as illustrated in FIGS. 11 and 12, the blank 11 is formed from a substantially square flat plate to a member having a square shell 11*a* with an end plate having a central square opening 14 and a flat wall 17 surrounding the central square opening 14 at a central portion of the member and a flat flange 11*b* at a portion of the member surrounding the square shell 11*a*.

In the apparatus, the position of each variable point bead 5 is selected so that the bead force of each variable point bead 5 is imposed on a portion of the flat wall 17 of the end plate adjacent a midpoint of each straight side of the central square opening 14. An operative coupling between each variable point bead 5 and the cam surface 13 via each pushing rod 12 is selected so that the bead force of each variable point bead 5 is imposed only at a later stage of the forming.

Thus, in the sheet forming (including drawing) method, the bead force of the variable point bead 5 is imposed on a portion of the flat wall 17 only at a later stage of the drawing time period.

If the flat wall 17 were extended too much, a breakage 22 would be caused in the flat wall 17. Because the bead force of each variable point bead 5 is effective only at a later stage of the sheet forming (including drawing) in the present invention, undue extension of the flat wall 17 is suppressed, so that a breakage 22 in the flat wall 17 at the corner of the square opening 14 is effectively prevented.

In a sixth embodiment of the present invention, as illustrated in FIGS. 13 and 14, the blank 11 is formed from a substantially circular flat plate to a member having a cylindrical shell 11*a* with an end plate having a central semispherical portion 16 at a central portion of the member and a flat flange 11*b* at a portion of the member surrounding the cylindrical shell 11*a*.

In the apparatus, the position of each variable point bead 5 is selected so that the bead force of each variable point bead 5 is imposed on the flat wall 17 of the end plate. An operative coupling between each variable point bead 5 and the cam surface 13 via each pushing rod 12 is selected so that the bead force of each variable point bead 5 is imposed only at an early stage of the forming.

In the sheet forming (including drawing) method, the bead force of each variable point bead 5 is imposed on the flat wall 17 only at an early stage of the forming time period.

Generally, in a conventional synthetic drawing including a first step for drawing the cylindrical shell 11*a*and a second step for drawing the semispherical portion 16, a part of the material of the portion 16 flows to the portion 11*a* during the first drawing step, and then in the second drawing step the portion 16 is formed in the condition that the material flow is restricted. As a result, a great strain is caused in the portion 16 during the second drawing step resulting in a breakage 23. In the present invention, because the flow of material from the portion 16 to the portion 11*a* during the first drawing step is restricted by operating each variable point bead 5 only at an early stage of the drawing, generation of a breakage 23 is effectively prevented at the stage of drawing the semispherical portion 16.

According to the foregoing embodiments of the present invention, because the bead force of each variable point bead 5 is made effective in a point manner only at a partial stage of the drawing, generation of a breakage in the blank during drawing is effectively prevented.

Further, because the variable bead 5 is a point-like bead, mounting the variable bead(s) to the blank holder or the opposing die is easily accomplished compared to conventional beads.

Although the present invention has been described with reference to specific exemplary embodiments, it will be appreciated by those skilled in the art that various modifications and alterations can be made to the particular embodiments shown without materially departing from the novel teachings and advantages of the present invention. Accordingly, it is to be understood that all such modifications and alterations are included within the spirit and scope of the present invention as defined by the following claims.

What is claimed is:

1. A method for sheet forming a blank using at least one variable point bead comprising the following steps of:

holding said blank between a blank holder and an opposing die so that wrinkling is essentially prevented in said blank;

forming said blank to an objective shape with a punch; and selectively imposing separate individual point-like bead forces on said blank at selected positions through one or more variable point beads and only during a partial time period of said forming step, wherein said variable point beads are not line beads.

2. A method according to claim 1, wherein during said holding step, said blank is further held between one or more fixed beads formed in at least one of said blank holder and/or said opposing die.

3. A method according to claim 1, wherein during said forming step, single-action sheet forming is conducted.

4. A method according to claim 1, wherein during said forming step, double-action sheet forming is conducted.

5. A method according to claim 1, wherein said blank is a substantially square flat plate during said holding step, and said blank is formed, during said forming step, to a member having a square shell with an end plate at a central portion of the member and a flat flange at a portion of the member surrounding the square shell, and wherein said forces of said one or more variable point beads are imposed on a portion of said flange adjacent a midpoint of each straight side of a square cross section of said square shell only during an early stage of said forming time period.

6. A method according to claim 1, wherein during said holding step said blank is a substantially square flat plate with four corners cut off, and said blank is formed, during said forming step, to a member having a square shell with an end plate at a central portion of the member and a flat flange at a portion of the member surrounding the square shell with said cut four corners of said blank corresponding to four corners of a square cross section of said square shell, and wherein said forces of said one or more variable point beads are imposed on a portion of said flange adjacent said four corners of said square cross section of said square shell more greatly during an early stage of said forming time period than during a later stage of said forming.

7. A method according to claim 1, wherein said blank is a substantially circular flat plate during said holding step, and said blank is formed, during said forming step, to a member having a cylindrical shell with an end plate at a central portion of the member and a flat flange at a portion of the member surrounding the cylindrical shell, and wherein said forces of said one or more variable point beads are imposed on a portion of said flange positioned on a diametrical line of a circular cross section of said cylindrical shell only during an early stage of said forming time period.

8. A method according to claim 1, wherein said blank is a substantially square flat plate during said holding step, and said blank is formed, during said forming step, to a member having a square shell at a central portion of the member with an end plate having a central square opening and a flat wall surrounding said central square opening, and a flat flange at a portion of the member surrounding the square shell at a central portion of the member, and wherein said forces of said one or more variable point beads are imposed on a portion of said flat wall of said end plate adjacent a midpoint of each straight side of said central square opening only during a later stage of said forming time period.

9. A method according to claim 1, wherein said blank is a substantially circular flat plate during said holding step, and said blank is formed, during said forming step, to a member having a cylindrical shell at a central portion of the member with an end plate having a central semispherical portion, and a flat wall surrounding said central semispherical portion, and a flat flange at a portion of the member surrounding the cylindrical shell, and wherein said forces of said one or more variable point beads are imposed on said flat wall of said end plate only during an early stage of said forming time period.

10. A method according to claim 1, wherein said variable point beads are shaped substantially circular and not in a pinpoint shape.

11. A method according to claim 2, wherein said blank is a substantially square flat plate during said holding step, and said blank is formed, during said forming step, to a member having a square shell with an end plate at a central portion of the member and a flat flange at a portion of the member surrounding the square shell, and wherein forces of said one or more fixed beads are imposed on a portion of said flange along each straight side of a square cross section of said square shell during all stages of said forming time period, and said forces of said one or more variable point beads are imposed on a portion of said flange adjacent a midpoint of said each straight side of said square cross section of said square shell only during an early stage of said forming time period.

12. An apparatus for sheet forming a blank using at least one variable point bead comprising:

a blank holder and an opposing die for holding said blank therebetween so that wrinkling is essentially prevented in said blank;

a punch for forming said blank to an objective shape; and one or more variable point beads for selectively imposing separate individual point-like bead forces on selected portions of said blank and during only a part of an entire forming time period, wherein said variable point beads are not line beads.

13. An apparatus according to claim 12, further comprising one or more fixed beads formed in said blank holder and/or said opposing die.

14. An apparatus according to claim 12, wherein said apparatus includes a single-action press.

15. An apparatus according to claim 12, wherein said apparatus includes a double-action press.

16. An apparatus according to claim 11, wherein said variable point beads are shaped substantially circular and not in a pinpoint shape.

17. An apparatus according to claim 13, wherein said one or more variable point beads are mounted to said blank holder and/or said opposing die, and said punch further comprises a cam surface, said cam surface being operatively coupled to each of said one or more variable point beads so that each of said one or more variable point breads is moved toward and away from said blank by said cam surface.

18. An apparatus according to claim 17, wherein said blank is formed from a substantially square flat plate to a member having a square shell with an end plate at a central portion of the member and a flat flange at a portion of the member surrounding the square shell, positions of said one or more variable point beads are selected so that said forces of said one or more variable point beads are imposed on portions of said flange adjacent a midpoint of each straight side of a square cross section of said square shell, and the operative coupling between each of said one or more variable point beads and said cam surface is selected so that said forces of said one or more variable point beads are imposed only during an early stage of said forming time period.

19. An apparatus according to claim 17, wherein said blank is formed from a substantially square flat plate to a member having a square shell with an end plate at a central portion of the member and a flat flange at a portion of the member surrounding the square shell, positions of said one or more fixed beads are selected so that forces of said one or more fixed beads are imposed on portions of said flange along each straight side of a square cross section of said square shell, positions of said one or more variable point beads are selected so that said forces of said one or more variable point beads are imposed on portions of said flange adjacent a midpoint of said each straight side of said square cross section of said square shell, and the operative coupling between each of said one or more variable point beads and said cam surface is selected so that said forces of said one or more variable point beads are imposed only during an early stage of said forming time period.

20. An apparatus according to claim 17, wherein said blank is formed from a substantially square flat plate with four corners cut off to a member having a square shell with an end plate at a central portion of the member and a flat flange at a portion of the member surrounding the square shell with said cut four corners of said blank corresponding to four corners of a square cross section of said square shell, positions of said one or more variable point beads are selected so that said forces of said one or more variable point beads are imposed on portions of said flange adjacent each of said four corners of said square cross section of said square shell, and the operative coupling between each of said one or more variable point beads and said cam surface is selected so that said forces of said one or more variable point beads are imposed more greatly during an early stage of said forming time period than during a later stage of said forming time period.

21. An apparatus according to claim 17, wherein said blank is formed from a substantially circular flat plate to a member having a cylindrical shell with an end plate at a central portion of the member and a flat flange at a portion of the member surrounding the cylindrical shell, positions of said one or more variable point beads are selected so that said forces of said one or more variable point beads are imposed on portions of said flange positioned on a diametrical line of a circular cross section of said cylindrical shell, and the operative coupling between each of said one or more variable point beads and said cam surface is selected so that said forces of said one or more variable point beads are imposed only during an early stage of said forming time period.

22. An apparatus according to claim 17, wherein said blank is formed from a substantially square flat plate to a member having a square shell at a central portion of the member with an end plate having a central square opening and a flat wall surrounding said central square opening, and a flat flange at a portion of the member surrounding the square shell, positions of said one or more variable point beads are selected so that said forces of said one or more variable point beads are imposed on portions of said flat wall of said end plate adjacent a midpoint of each straight side of said central square opening, and the operative coupling between each of said one or more variable point beads and said cam surface is selected so that said forces of said one or more variable point beads are imposed only during a later stage of said forming time period.

23. An apparatus according to claim 15, wherein said blank is formed from a substantially circular flat plate to a member having a cylindrical shell at a central portion of the member with an end plate having a central semispherical portion and a flat wall surrounding said central semispherical portion, and a flat flange at a portion of the member surrounding the cylindrical shell, positions of said one or more variable point beads are selected so that said forces of said one or more variable point beads are imposed on said flat wall of said end plate, and the operative coupling between each of said one or more variable point beads and said cam surface is selected so that said forces of said one or more variable point beads are imposed only during an early stage of said forming time period.

* * * * *

UNITED STATES PATENT AND TRADEMARK OFFICE

CERTIFICATE OF CORRECTION

PATENT NO. : 5,901,599

DATED : May 11, 1999

INVENTOR(S) : SATO et al.

It is certified that error appears in the above-identified patent and that said Letters Patent is hereby corrected as shown below:

ON COLUMN 11

Please change the dependency of claim 16 from "11" to --12--.

ON COLUMN 12

Please change the dependency of claim 23 from "15" to --17--.

Signed and Sealed this

Twenty-first Day of December, 1999

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT NO. : 5,901,599
DATED : May 11, 1999
INVENTOR(S) : SATO et al.

It is certified that error appears in the above-identified patent and that said Letters Patent is hereby corrected as shown below:

On the title page, item

[73] Assignees: Please change

"Kabushiki Kaisha Toyota Chuokenkyusho"
to
-- Kabusiki Kaisha Toyota Chuo Kenkyusho--

Signed and Sealed this
Fourth Day of July, 2000

*Attest:*

Q. TODD DICKINSON

*Attesting Officer*

*Director of Patents and Trademarks*